US005498166A

United States Patent [19]

Rothenberger

[11] Patent Number: 5,498,166

[45] Date of Patent: Mar. 12, 1996

[54] INTERCONNECT SYSTEM

[75] Inventor: Richard E. Rothenberger, Harrisburg, Pa.

[73] Assignee: The Whitaker Corporation, Wilmington, Del.

[21] Appl. No.: 269,256

[22] Filed: Jun. 30, 1994

[51] Int. Cl.[6] ..... H01R 23/72

[52] U.S. Cl. ..... 439/66

[58] Field of Search ..... 439/66, 71, 91, 439/591

[56] References Cited

U.S. PATENT DOCUMENTS

| | | | |
|---|---|---|---|
| 4,699,593 | 10/1987 | Grabbe et al. | 439/71 |
| 4,711,509 | 12/1987 | Cross et al. | 439/587 |
| 4,802,869 | 2/1989 | Maue | 439/587 |
| 4,906,194 | 3/1990 | Grabbe | 439/71 |
| 4,969,826 | 11/1990 | Grabbe | 439/66 |
| 4,998,886 | 3/1991 | Werner | 439/66 |
| 5,069,627 | 12/1991 | Buck et al. | 439/66 |
| 5,427,536 | 6/1995 | Petersen et al. | 439/71 |

*Primary Examiner*—Gary F. Paumen
*Attorney, Agent, or Firm*—June B. Schuette

[57] ABSTRACT

An environmentally sealed interconnect system (10) having a male connector housing (20) and a female connector housing (21). A plurality of spaced-apart contact locator ribs (34) and contact mounting ribs (38) are formed in the male connector housing (20) and are received with a force fit in a corresponding plurality of spaced-apart cooperating sealing areas (45), (50) in the female connector housing (21). The ribs (34), (36) and sealing areas (45), (50) form a sealed interconnect system (10). A plurality of spaced-apart interposer contacts (26) are disposed in the interconnect system (10) secured therein by the ribs (34), (35). An O-ring sealant (31) is disposed about the periphery of the interconnect system (10) to provide an outer environmental seal for the interconnect system (10).

10 Claims, 6 Drawing Sheets

INTERCONNECT SYSTEM

FILED OF THE INVENTION

The present invention relates to an interconnect system and in particular, to an environmentally sealed interconnect system to be used with a hard disc drive assembly to permit electrical access to the sealed portion therein.

BACKGROUND OF THE ART

Hard disc drive assemblies are manufactured in a clean room environment to reduce contamination to the sensitive electronic portion of the assembly. Subsequent to manufacture, it is often necessary to access the sealed portion of the assembly without opening the assembly and introducing contamination into the assembly. The current state-of-the-art is to provide a window in the assembly with electrical connectors to the components of the sealed portion. This may be by a pad or other means for electrical contact being formed at an interface with the window.

Various means for effecting connections between two electrical surfaces are known. U.S. Pat. No. 4,699,593 to Grabbe et al disclose a connector for a substrate having a housing frame with a plurality of contact members held in position with a threaded bolt. U.S. Pat. No. 4,711,509 to Cross et al disclose an electrical connector having a connector body with a plurality of male pin terminals and a mating plug in electrical connector. The connector has a terminal cavity extending axially through the connector body. U.S. Pat. No. 4,802,869 to Maue discloses a portable electrical connector assembly including a plurality of mating terminals accommodated in mated housings. Openings are provided in the housing to allow insertion of a probe to make electrical measurements. A reusable seal is positioned around the housing to cover the openings. U.S. Pat. No. 4,906,194 to Grabbe discloses a high density connector assembly for an IC chip carrier which includes a stack of spacer plates holding planar contact members and upper and lower reference plates. The assembly is held together by a plurality of threaded screws. U.S. Pat. No. 4,969,826 to Grabbe discloses a connector assembly for interconnecting a relatively large integrated circuit chip carrier with a printed circuit board. The connector assembly includes a holder composed of a stack of several thin plates having perforations arranged on desired grid patterns. U.S. Pat. No. 4,998,886 to Werner discloses an electrical connector having a plurality of contacts arranged in a side-by-side relationship and held between a base and a cover plate. The base is solvent bonded to the cover plate. U.S. Pat. No. 5,069,627 to Buck et al disclose an electrical connector for electrically connecting circuit boards which comprises two housings engaged by interlocked tongue and grooves on the respective housings.

One method for electrical connection which has been used is to form a pin on the contact and to form a plastic or insulated collar about the pin for connection to a plug in which the pin is received. However, the pin/collar connector requires the use of a plastic or potting material which outgasses volatile substances and which contaminates highly sensitive electronic components. None of the above-referenced connectors are directed to systems which have been assembled in clean rooms and in which the maintenance of an environmentally sealed portion is a factor.

There remains a need for an environmentally sealed connector which can interface with the electrical contacts of an environmentally sealed portion of a unit and can permit electrical access thereto while preserving the environmental protection.

SUMMARY OF THE INVENTION

The present invention provides an interconnect which permits electrical access to the environmentally sealed portion of a hard disc drive assembly.

In accordance with the teachings of the present invention, there is disclosed an environmentally sealed interconnect system for use with a hard disc drive assembly having an environmentally sealed portion and a window permitting access to electrical contacts for the sealed portion. The interconnect system includes a non-electrically conducting male connector housing and a non-electrically conducting female connector housing. A plurality of spaced-apart insulating ribs are formed in the male connector housing and a plurality of electrically conducting interposer contacts are disposed in the male connector housing. Each interposer contact is disposed adjacent to a respective insulating rib, wherein each interposer contact is electrically insulated from each adjacent interposer contact. The female connector housing has a plurality of spaced-apart rib sealing areas formed therein. The male connector housing is mated with the female connector housing, wherein the respective insulating ribs are received in the respective rib sealing areas and form a seal therebetween and with the interposer contacts to prevent passage of environmental contaminants from one side of the interconnect system to an opposite side thereof.

Preferably, the male connector housing and the female connector housing each have a respective outer periphery. A first groove is formed in the outer periphery of the male connector housing and a second groove is formed in the outer periphery of the female connector housing. In this manner, when the male connector housing is mated to the female connector housing, the first groove communicates with the second groove. A sealant means is received in the first groove and the second groove about the periphery of the interconnect system.

These and other objects of the present invention will become apparent from a reading of the following specification, taken in conjunction with the enclosed drawings.

DESCRIPTION OF THE PREFERRED EMBODIMENTS

Figure 1:
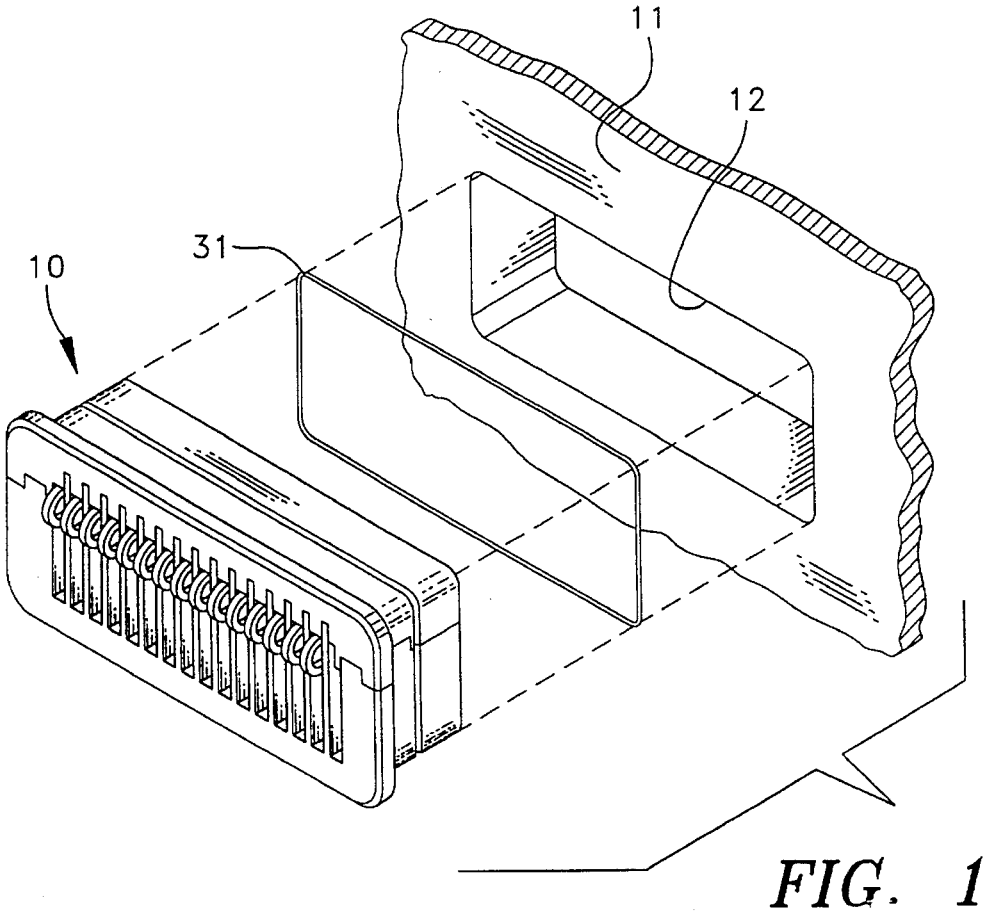
FIG. 1 is a perspective view of the interconnect system of the present invention disposed in a hard disc drive assembly.
Figure 3:
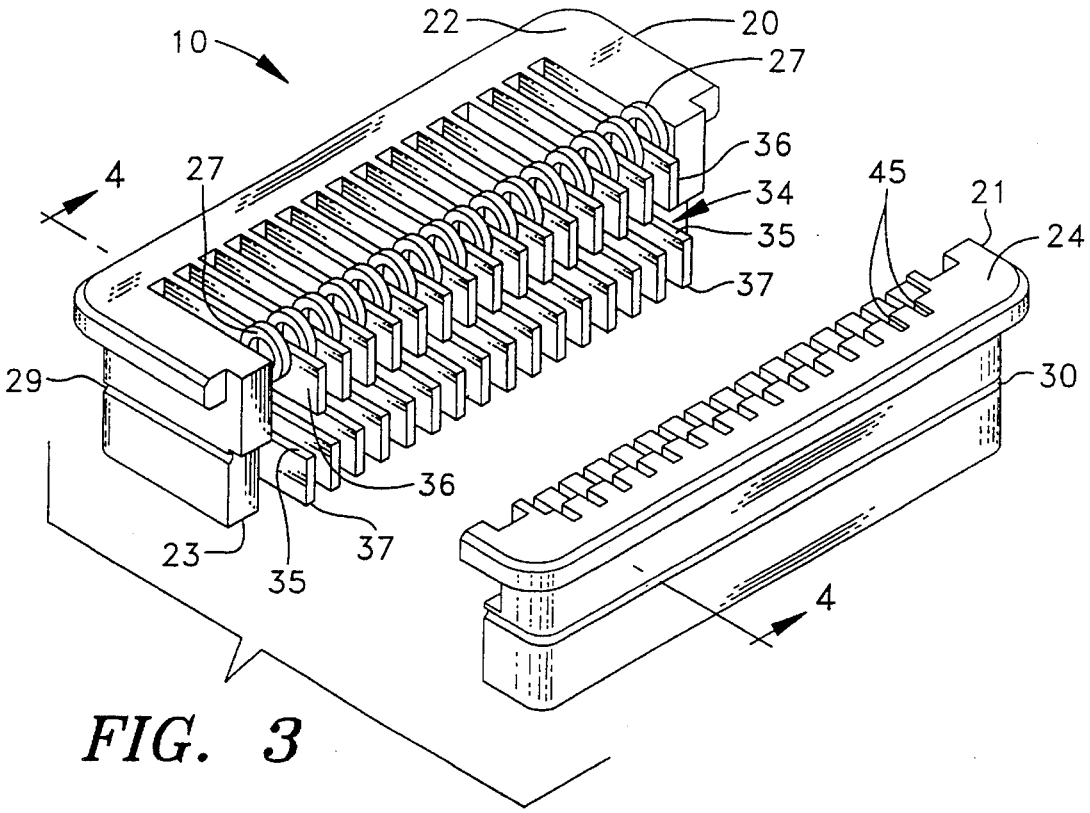
FIG. 3 is a perspective view of the present invention showing the male connector housing separated from the female connector housing.
Figure 4:
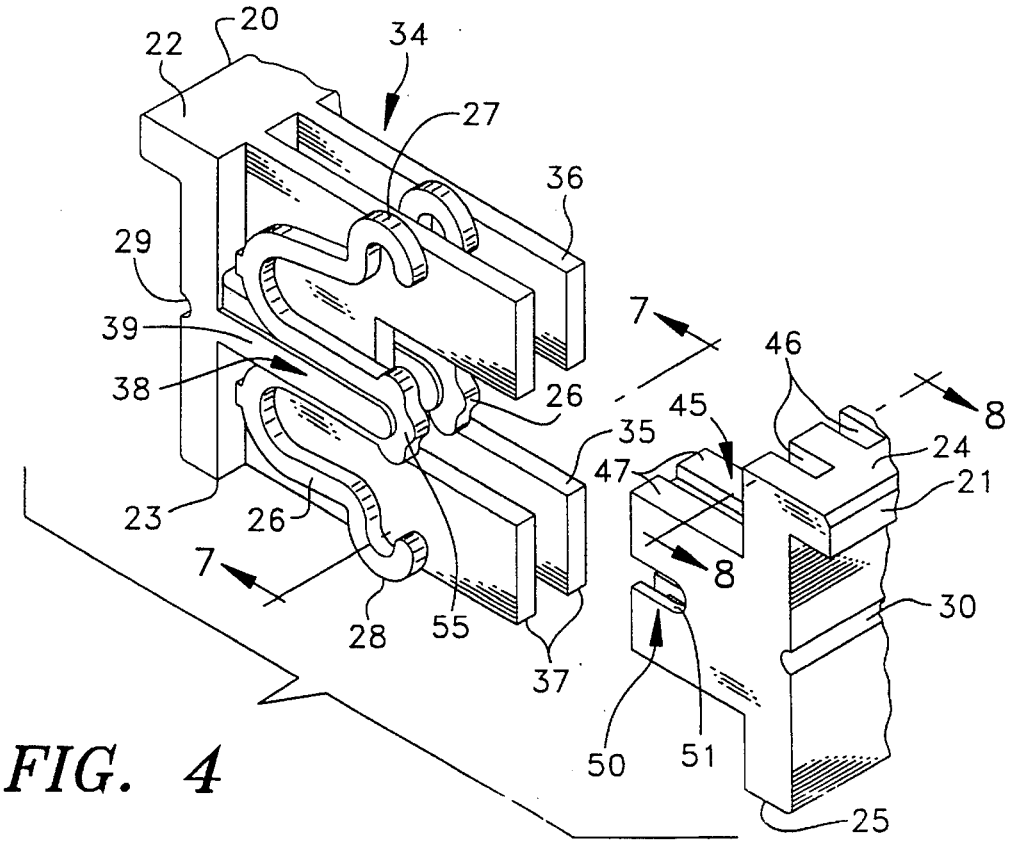
FIG. 4 is a cross-sectional view taken across the lines 4—4 of FIG. 3 showing the male housing and the female housing unmated.
Figure 5:
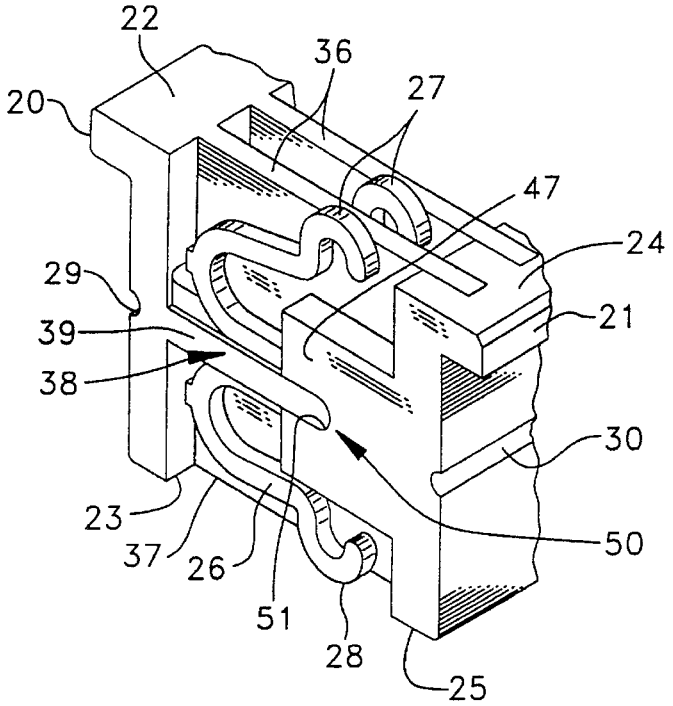
FIG. 5 is a cross-sectional view taken across the lines 5—5 of FIG. 2 showing the male housing and the female housing mated.
Figure 6:
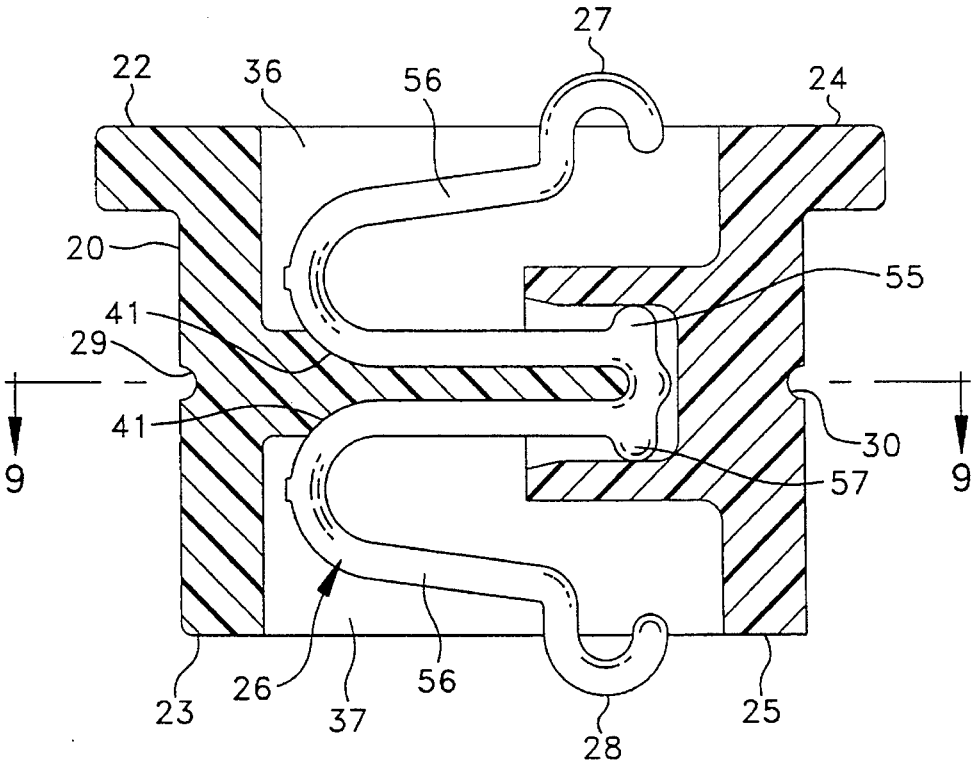
FIG. 6 is a cross-sectional view of the male housing mated to the female housing.
Figure 7:
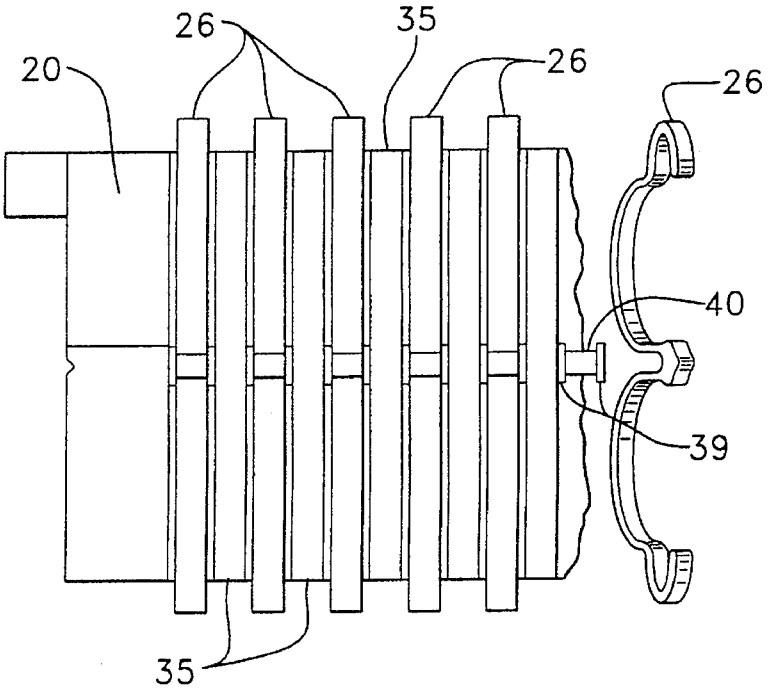
FIG. 7 is a cross-sectional view taken across the lines 7—7 of FIG. 4.
Figure 8:
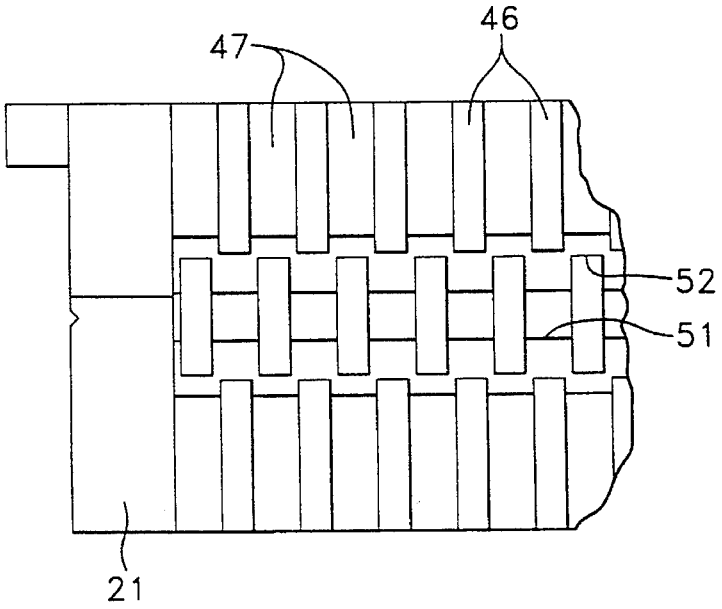
FIG. 8 is a cross-sectional view taken across the lines 8—8 of FIG. 4.
Figure 9:
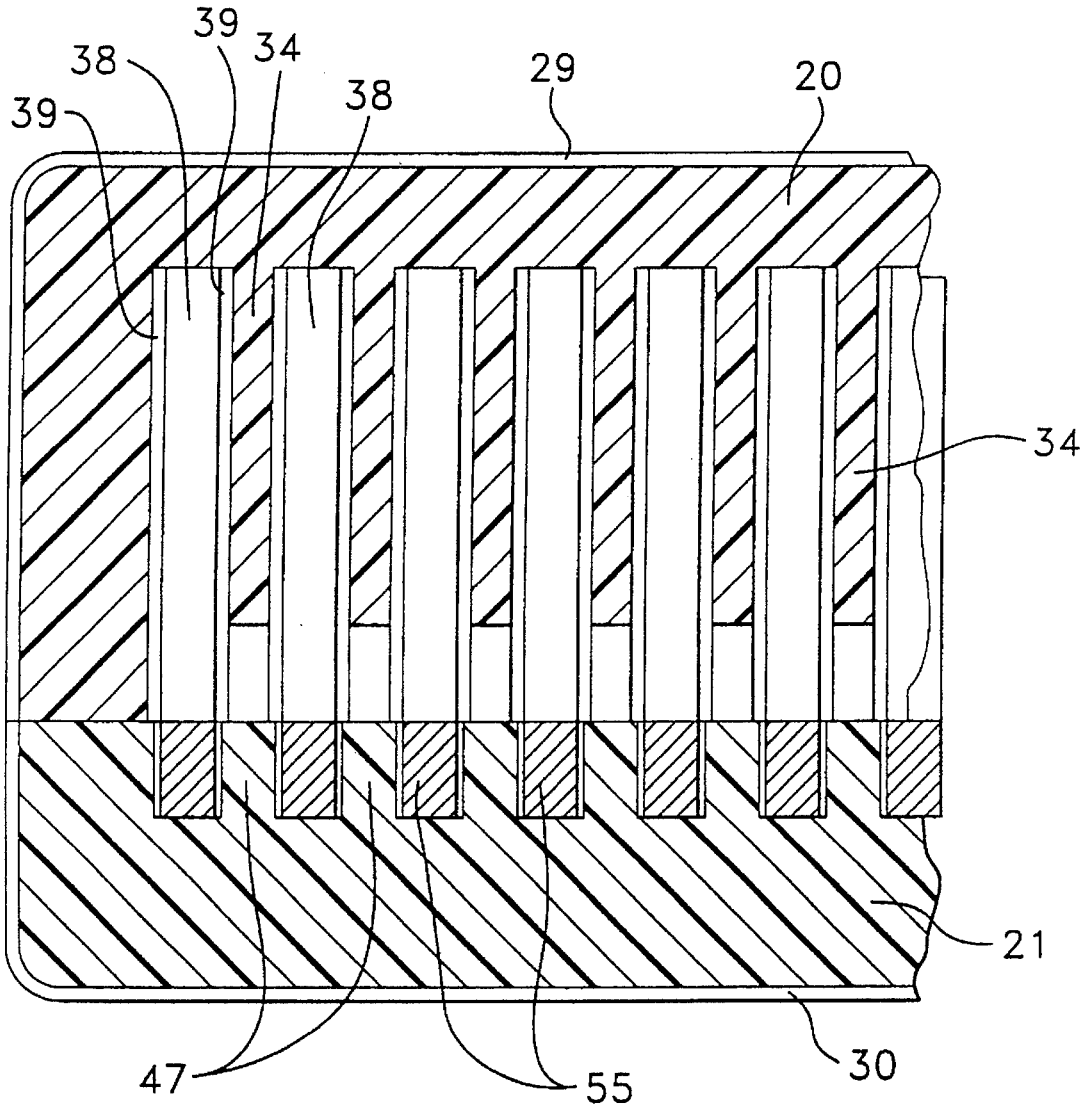
FIG. 9 is a cross-sectional view taken across the lines 9—9 of FIG. 6.
Figure 10:
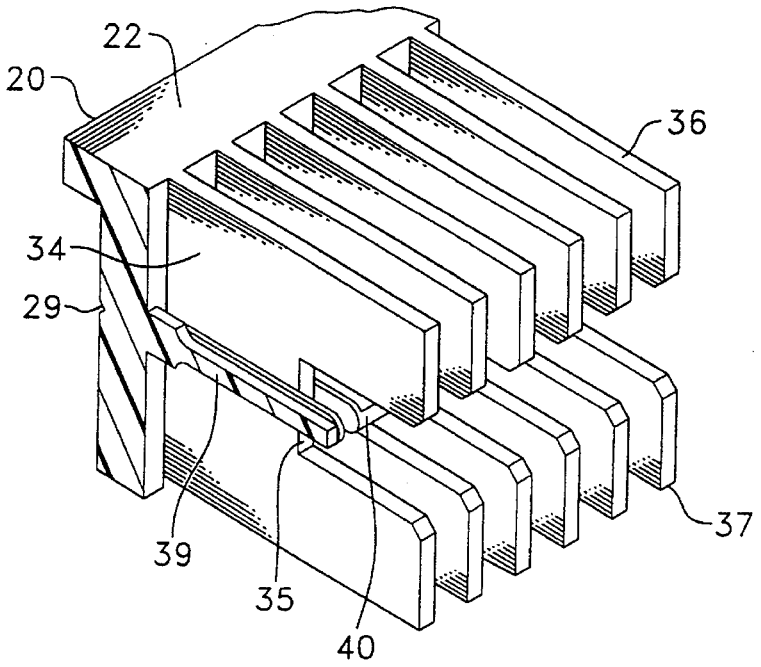
FIG. 10 is a perspective cut-away view of the male housing.
Figure 11:
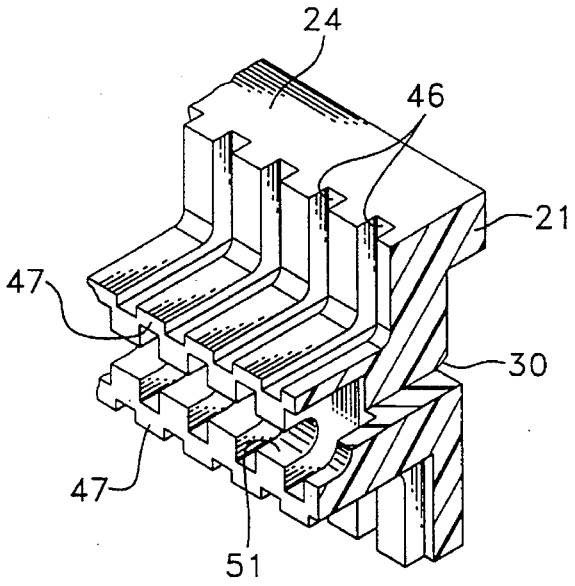
FIG. 11 is a perspective cut-away view of the ferrule housing.

Referring to FIG. 1, the interconnect system 10 of the present invention is shown as being disposed in an opening 12 in a hard disc drive assembly 11.

Figure 2:
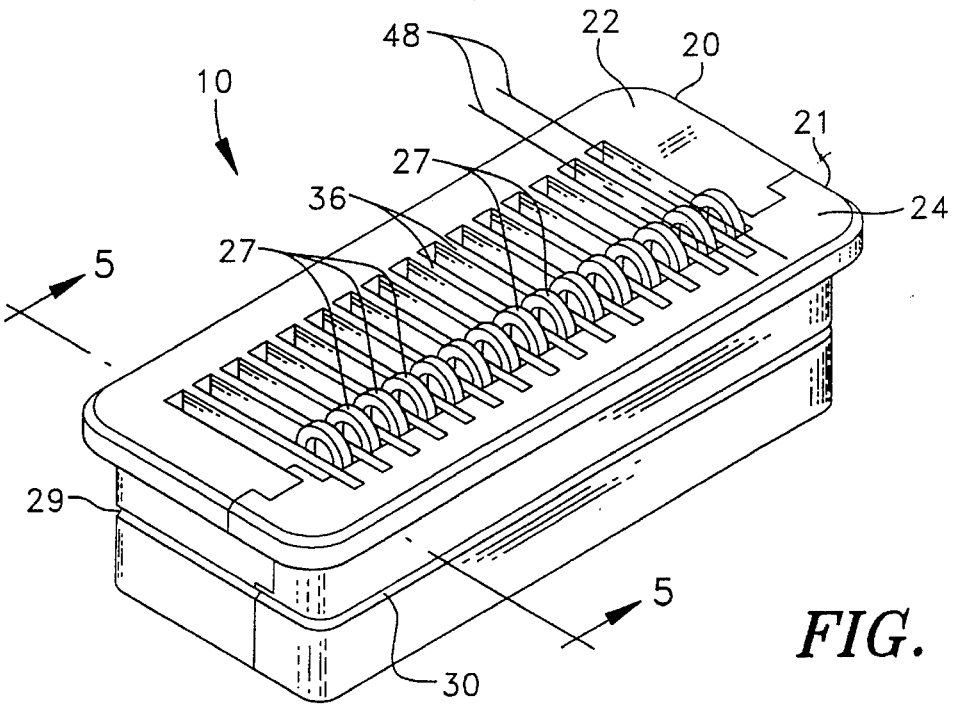
FIG. 2 is a perspective view of an assembled interconnect system of the present invention.

As shown in FIG. 2, the interconnect system 10 of the present invention has a male connector housing 20 and a female connector housing 21 which are mated together. The male connector housing 20 has a first side 22 and an opposite second side 23 which is substantially parallel to the first side 22. Similarly, the female connector housing 21 has a first side 24 and an opposite second side 25 which is substantially parallel to the first side 24. When the male and female housings 20, 21 are mated, the respective first sides 22, 24 and the respective second sides 23, 25 are adjoining one another. The male connector housing 20 and the female connector housing 21 are formed from a non-electrically conducting material such as a rigid plastic. Disposed within the male connector housing 20 are a plurality of spaced-apart interposer contacts 26 as will be described. Each interposer contact 26 has a first interface 27 which extends outwardly from, and approximately perpendicular to, the first side 22 of the male connector housing 20. Each interposer contact 26 also has a second interface 28 which extends outwardly from, 10 and approximately perpendicular to, the second side 23 of the male connector housing 20. The male connector housing 20 and the female connector housing 21 each have a respective outer periphery between the respective first sides 22, 24 and the respective second sides 23, 25. Formed in the outer periphery of the male connector housing 20 is a first groove 29 which extends completely around the outer periphery. Formed in the outer periphery of the female connector housing 21 is a second groove 30 which extends completely around the outer periphery. When the male connector housing 20 and the female connector housing 21 are mated, the first groove 29 is directly aligned with and communicates with the second groove 30. A sealant means 31 is disposed in the first groove 29 and the second groove 30 and the sealant means 31 extends around the peripheries of the mated male connector housing 20 and the female connector housing 21. The sealant means 31 may be an elastomeric O-ring which provides an exterior seal between the interconnect system 10 and the hard disc assembly 11 as will be described.

As shown in FIGS. 3–11, a plurality of spaced-apart insulating ribs are formed in the male connector housing 20. The insulating ribs are of two types. Contact locator ribs 34 adjoin the periphery of the male connector housing 20 from the first side 22 to the second side 23 and extend perpendicularly inwardly. A segment is cut away from each contact locator rib 34 distal from the periphery of the male connector housing 20 forming an opening 35 between an upper leg 36 and a lower leg 37 such that the contact locator rib 34 is C-shaped. The other ribs are contact mounting ribs 38 which adjoin the periphery of the male connector housing 20 approximately midway between the first side 22 and the second side 23 and extend perpendicularly inwardly approximately parallel to the first side 22 and the second side 23. Each contact mounting rib 38 is joined to and disposed between a pair of adjacent contact locator ribs 36. Each contact mounting rib 38 has a pair of spaced-apart fingers 39 which are approximately identical lengths. Each finger 39 of each contact mounting rib 31 is oriented in a respective plane, all of the planes being parallel to one another and also being substantially perpendicular to the first side 22 and the second side 23 of the male connector housing 20. Disposed between the fingers 39 of each contact mounting rib 38 is a respective member 40 which has a length shorter than the adjacent fingers 38. Each member 40 also has a respective shoulder 41 formed thereon, the shoulder being proximal to the periphery of the male connector housing 20.

The female connector housing 21 has a plurality of spaced-apart rib sealing areas 45 formed therein. The rib sealing areas 45 are in the form of a plurality of spaced-apart slots 46 formed in the female connector housing 21 depending from both the first side 24 and the second side 25 of the female connector housing 21. Each slot 46 on the first side 24 is oriented opposite from corresponding slot 46 on the second side 25. Between each pair of opposite slots 46 is a projection 47 which extends outwardly from the female connector housing 21 such that a plurality of spaced-apart projections 47 are provided.

When the male connector housing 20 is mated with the female connector housing, the legs 36, 37 of each contact locator rib 34 are received with a force fit into the cooperating slots 46 of the respective rib sealing areas 21 and, simultaneously, each projection 47 from the respective rib sealing areas 21 is received with a force fit in the opening 35 in the contact locator rib 34. In this manner, an environmental seal is formed within the interconnect system 10 which is free of sealants such as epoxy or potting materials.

The female connector housing 21 also has formed therein a plurality of spaced-apart contact sealing areas 50. Each contact sealing area 50 has a cutout portion 51 of the respective projection 47 and is formed to receive with a force fit, and cooperate with the pair of fingers 39 of the respective contact mounting rib 38 of the male connector housing 20 when the female connector housing 21 is mated thereto. A cavity 51 is formed in each of the contact sealing areas 50 and a portion of the respective interposer contact 26 is received in the respective cavity 51 as will be described.

Each interposer contact 26 is formed from an electrically conducting material which preferably is a high strength beryllium copper base metal. Each interposer contact 26 is substantially W-shaped having a central bight portion 55 with a pair of U-shaped arms 56 connected thereto. The outer extremities of each arm 56 have a respective first arcuate interface 27 and a respective second arcuate interface 28. The interfaces 27, 28 preferably are coated with a tin-lead or gold surface to reduce oxidative effects on the respective interfaces. When contact is made between the respective interfaces 27, 28 and the electrical contact on the environmentally sealed portion of the hard disc drive assembly or the desired electrical contact opposite thereto, the respective arms 56 of the interposer contact 26 flex toward the bight portion 55 of the interposer contact 26. In so flexing, a wiping type of electrical contact is made which provides an improved electrical connection.

Each interposer contact 26 is disposed in the male connector housing 20 with the arms 56 between the fingers 39 of the respective contact mounting rib 38 such that the arms 56 straddle the shorter member 40 of the respective contact mounting rib 38. The bight portion 55 of each interposer contact 26 is received in the cavity 52 in the respective contact sealing area 50 in the female connector housing 21. In this manner, each interposer contact 26 is insulated from each adjoining interposer contact 26 and each interposer contact 26 is restrained from lateral movement. Further, each interposer contact 26 is environmentally sealed within the contact system 10 without any sealant or potting material being present.

Further, the bight portion 55 of each interposer contact 26 has an enlarged segment 57 adjacent to each arm 56. The enlarged segments 57 contact the walls of the cavity 52 and provide additional sealing to the contact system 10. The enlarged segments 57 also provide a firm base for flexing of the arms 56 of each interposer contact 26 when contact is made with the interface 27, 28 of the interposer contact 26.

The respective contact locator ribs 34 and rib sealing areas 45 are oriented and disposed in the contact system 10 such that the interposer contacts 26 are each oriented on a respective center line 48. Each center line 48 is spaced apart from each adjacent center line by a minimum of 0.025 inches (0.635 mm).

The sealant means 31 around the periphery of the contact system 10 provides an environmental seal between the exterior of the contact system 10 and the hard disc drive assembly 11 when the contact system 10 is disposed in the window. Thus, by the combination of the ribs and sealing areas within the contact system 10 and the sealant means 31 about the contact system 10, the environmental seal of the hard disc drive assembly 11 is protected.

A further advantage of the present contact system 10 is the compatibility with robotic assembly techniques. The interconnecting mating features of the male connector housing 20 and the female connector housing 21, which form an environmental seal, permit rapid and simple assembly which can be effected by automated mechanical means without manual intervention. There is no need for potting procedures which introduce volatile contaminants and require curing times. Thus, the costs for assembly and time for assembly are significantly reduced.

Obviously, many modifications may be made without departing from the basic spirit of the present invention. Accordingly, it will be appreciated by those skilled in the art that within the scope of the appended claims, the invention may be practiced other than has been specifically described herein.

What is claimed:

1. An environmentally sealed interconnect system for use between two parallel substrates and for use with an assembly having an environmentally sealed portion and a window permitting access to electrical contacts, the interconnect system comprising a non-electrically conducting male connector housing and a non-electrically conducting female connector housing, a plurality of spaced-apart insulating ribs being formed in the male connector housing, a plurality of electrically conducting interposer contacts disposed in the male connector housing, each interposer contact being disposed adjacent to a respective insulating rib, wherein each interposer contact is electrically insulated from each adjacent interposer contact, the female connector housing having a plurality of spaced-apart rib sealing areas formed therein, the male connector housing being mated with the female connector housing, wherein the respective insulating ribs are received in the respective rib sealing areas and form a seal therebetween and with the interposer contacts to prevent passage of environmental contaminants from one side of the interconnect system to an opposite side thereof.

2. The interconnect system of claim 1, wherein each interposer contact is oriented on a respective center line, each pair of adjacent center lines being spaced apart by a minimum of 0.025 inches.

3. The interconnect system of claim 1, wherein each interposer contact has a first interface and an opposite second interface, the male housing having a first side and an opposite second side, the first interface of each respective interposer contact extending outwardly from the first side of the male housing, the first interfaces being in contact with the electrical contacts of the sealed portion, the second interfaces being external to the environmentally sealed interconnect system permitting electrical access to the sealed portion while preserving the environmental seal.

4. The interconnect system of claim 1, further comprising the male connector housing and the female connector housing each having a respective outer periphery, a first groove formed in the outer periphery of the male connector housing and a second groove formed in the outer periphery of the female connector housing wherein, when the male connector housing is mated to the female connector housing, the first groove communicates with the second groove, a sealant means being received in the first groove and the second groove about the periphery of the interconnect system to environmentally seal the interconnect system within the assembly.

5. The interconnect system of claim 4, wherein the sealant means in an elastomeric O-ring.

6. The interconnect system of claim 1, wherein the insulating ribs comprise a plurality of contact locator ribs formed in the male connector housing, each contact locator rib being substantially C-shaped having an upper leg and a lower leg with an opening therebetween, the respective upper legs and lower legs of each contact locator rib being received with a force fit in the respective rib sealing areas in the female housing connector, the female housing connector further having a plurality of spaced-apart projections extending outwardly from the female connector housing, each projection being aligned with a respective rib sealing area, each projection being received with a force fit in the respective opening in the cooperating contact locator rib, wherein the male connector housing is mated to the female connector housing to form an environmental seal therebetween free of sealants.

7. The interconnect system of claim 1, wherein the insulating ribs further comprise a plurality of spaced-apart contact mounting ribs formed in the male connector housing, the male connector housing having a first side and an opposite second side, each contact mounting rib being disposed approximately at a midpoint between the first side and the second side and being approximately parallel to the first side and the second side, each contact mounting rib having a pair of spaced-apart equal length fingers with a member therebetween, the member having a length shorter than the adjacent fingers; a plurality of spaced-apart contact sealing areas formed in the female connector housing, the fingers of the respective contact mounting ribs being received with a force fit in the respective contact sealing areas wherein the male connector housing is mated to the female connector housing to form an environmental seal therebetween free of sealants.

8. The interconnect system of claim 7, wherein the fingers of each contact mounting rib is oriented in a respective plane, each of the respective planes being parallel to one another and each of the respective planes being substantially perpendicular to the first side and the second side of the male connector housing.

9. The interconnect system of claim 7, wherein each interposer contact is substantially W-shaped having a bight portion at a midpoint thereof and a pair of arms extending from the bight portion, each interposer contact being disposed in the interconnect system, the bight portion of each interposer contact being received in the respective contact sealing area in the female connector housing and the arms of each interposer contact being oriented between the fingers of the respective contact mounting rib, the arms straddling the shorter member of the respective contact mounting rib, thereby restraining lateral movement of the respective interposer contacts and forming an environmental seal about the respective interposer contacts.

10. The interconnect system of claim 7, wherein the bight portion of each interposer contact has an enlarged segment adjacent to each arm, the enlarged segments contacting the respective contact sealing area in the female connector housing and forming a seal therebetween.

* * * * *